US006395089B1

(12) United States Patent
Houston

(10) Patent No.: US 6,395,089 B1
(45) Date of Patent: May 28, 2002

(54) WALL PAPER PASTING SYSTEM

(76) Inventor: Wallace S. Houston, 80 Sunset Rd., McDough, GA (US) 30253

( * ) Notice: Subject to any disclaimer, the term of this patent is extended or adjusted under 35 U.S.C. 154(b) by 0 days.

(21) Appl. No.: 09/729,160

(22) Filed: Dec. 4, 2000

(51) Int. Cl.[7] ..... B05C 3/02
(52) U.S. Cl. ..... 118/413; 118/415; 118/DIG. 17
(58) Field of Search ..... 156/575, 578; 118/DIG. 17, 413, 123, 419, 429

(56) References Cited

U.S. PATENT DOCUMENTS 1,265,127 A 5/1918 Sleeper
2,264,501 A 12/1941 Beach
3,122,781 A * 3/1964 Mutter
4,159,695 A 7/1979 Newman
5,230,737 A 7/1993 Takada et al.
5,330,575 A 7/1994 Poole et al.
5,336,323 A 8/1994 Cotton et al.
5,421,886 A 6/1995 Poole et al.
5,795,387 A 8/1998 Huerta
5,824,363 A 10/1998 Poole et al.

* cited by examiner

*Primary Examiner*—Brenda A. Lamb
(74) *Attorney, Agent, or Firm*—William B. Noll

(57) ABSTRACT

A portable and table mounted, wall paper pasting apparatus. The apparatus includes a housing containing a trough for receiving and transferring paste to the back side of wall paper. The housing features a removable wall containing a manually adjustable squeegee to control and distribute the paste onto the wall paper.

9 Claims, 2 Drawing Sheets

WALL PAPER PASTING SYSTEM

FIELD OF THE INVENTION

This invention is directed to the field of wall paper pasting apparatus, more particularly to a table mounted pasting system having an adjustable, transverse squeegee member to control distribution of the paste on the wall paper.

BACKGROUND OF THE INVENTION

The present invention relates to apparatus for evenly applying wall paper paste to the back of wall paper. Hanging of wall paper is becoming a popular do-it-yourself product for many homeowners, and is often undertaken by a homeowner having limited experience in such a project. It represents a convenient way of decorating a room to reflect the chosen fashion of the homeowner. To decorate the wall, wall paper is placed and applied to the wall by applying and/or spreading paste on the back side of the wall paper, followed by placing the back side of the paper to the wall. Thereafter, the wall paper is smoothed against the wall by a variety of tools. Various devices have been developed to assist the wall paper hanger in performing the task of applying paste to the wall paper, where a number of the devices are described in the following U.S. Patents:

a.) U.S. Pat. No. 5,824,363, to Poole et al., teaches a wall paper pasting machine having a lid and a trough. The lid can completely cover the trough to keep the paste from further drying out. An applying roller for applying paste to wallpaper is placed within the inner compartment of the trough. A scraper bar is mounted at the rear portion of the trough, and the scraper bar scrapes excess paste from wallpaper. A snap lock located on the lid is used to secure the lid to the trough. Paper tension ribs are located in the interior portion of the lid for providing tension on the wall paper and for guiding and pressing the wall paper to the applying roller to apply paste onto the wall paper as the wall paper is pulled through the machine. A return roller can be adjusted in position and held to one of three sets of holes that are on the lid. The position adjustment of the return roller allows the thickness of paste that is applied to the wall paper to be varied. The pasting machine can be mounted, attached, or fixed to a surface. Paste is applied to the wall paper being generally placed over the applying roller, pulled through pasting machine, and pulled around and over return roller.

b.) U.S. Pat. No. 5,795,387, to Huerta, discloses a paste applying apparatus including a trough having an upstream end, a downstream end and opposing sidewalls, an applicator roller carried by the trough, and an adjustable scraper bar carried by the trough upstream of and adjacent to the applicator roller. The apparatus includes an adjustment assembly for adjusting the scraper bar for allowing a user to adjust the amount of paste removed from the surface of the wallpaper, a lid removably and hingedly coupled to the trough for movement between an open position and a closed position, and an outfeed roller carried proximate the trough upstream of the scraper bar.

c.) U.S. Pat. No. 5,421,886, to Poole et al., relates to a paste dispenser having a paste reservoir and an applicator for containing and applying paste to wall paper. A package having a container and a base, transformable between a package configuration wherein the paste dispenser is received within the container and the container is closed by the base, and an applicator configuration wherein the base extends from the container and carries the paste dispenser. Arresting means is provided in contact with the wall paper for limiting the flow of paste from the paste dispenser.

d.) U.S. Pat. No. 5,336,323, to Cotton et al., teaches a wall paper dispenser for automatically hydrating a film of glue pre-applied to one side of a roll of wall paper. The dispenser includes a reservoir having a roll of wall paper rotatably supported thereover and a roller for guiding the wall paper within a quantity of water contained within the reservoir. A ramp is provided for cutting the wallpaper and includes a cutting ridge along which a cutting member is drawn to cut the wall paper perpendicular to the length thereof. A tape measure and means for securing the tape measure adjacent the ridge are provided to indicate the point, forwardly of the ridge, adjacent which the forward margin of the wallpaper should be positioned. A slidable member is provided to automatically align the pattern on one strip of the wall paper with the same pattern on a previously cut strip when the strips are positioned in laterally adjacent relation and with the top margins thereof in alignment.

e.) U.S. Pat. No. 5,330,575, to Poole et al., discloses apparatus for applying paste, which apparatus includes a trough having an upstream end and a downstream end removably carrying an applicator roller rotated by driving means and a scraper bar. The scraper bar is upstream of and adjacent the applicator roller with a pressure area downstream of the applicator roller. A lid hingedly coupled to the trough, carrying an outfeed roller downstream of the scraper bar, is provided for guiding wall paper over the applicator roller and the scraper bar.

f.) U.S. Pat. No. 5,230,737, to Takada et al., relates to a wall paper pasting apparatus characterized in that the wall paper pasting apparatus is provided with a pasting roller and a pressing guide for pressing the wall paper against the upper surface thereof, by a plurality of leveling plate means having edge wavy grooves for adjusting the thickness of the paste layer transferred onto the wallpaper.

g.) U.S. Pat. No. 4,159,695, to Newman, teaches a wall paper paste applicator comprising a container having an inclined trap bottom portion along which a strip of wallpaper travels with its decorative surface facing downward. The paper is pulled through a slot in the forward portion of the apparatus formed by a vertically adjustable wall and the bottom of the tray. A quantity of paste is maintained on top of the wallpaper in the tray, and is distributed to the back of the paper by a flexible notched wiping bar.

While the above enumerated prior art offer a variety of aids in helping a wall paper hanger in the application of paste to the back side of wall paper, none provide the simplicity of controlling the quantity of applied paste. The manner by which the present invention provides the improved control on the application of paste will become more apparent in the description which follows.

SUMMARY OF THE INVENTION

The present invention is directed to a portable and table mounted apparatus for applying and controlling distribution of paste to the back side of wall paper. The apparatus comprises a housing having a slanted floor, a pair of opposing side walls, and a removably adjustable third wall. With the floor slanting toward the third wall, in cooperation with the opposing side walls, a paste receiving trough is provided through which the paper from a continuous roll passes. The third wall comprises an inverted U-shaped channel member, such as two L-shaped members joined at the respective short legs, and a top wall. Within the channel a slidable and adjustable squeegee bar extends between the joined L-shaped members. Through manual means in the top wall the squeegee bar may be adjusted to control the quantity of paste applied to the wall paper. In a preferred embodiment, the third wall is received in facing slots in the opposing side walls, and may be temporarily secured therein by threaded members. Further, a length counter and feeding reel may be provided to complement the apparatus.

Accordingly, an object of the invention is to provide an apparatus for applying and controlling the quantity of paste spread on the back side of wall paper.

A further object hereof is the provision of manual means to activate a squeegee bar to assist in controlling the spreading of paste.

Another object of the invention lies in the use of a non-metallic squeegee bar for bearing against the wall paper.

DETAILED DESCRIPTION OF PREFERRED EMBODIMENT

Figure 1:
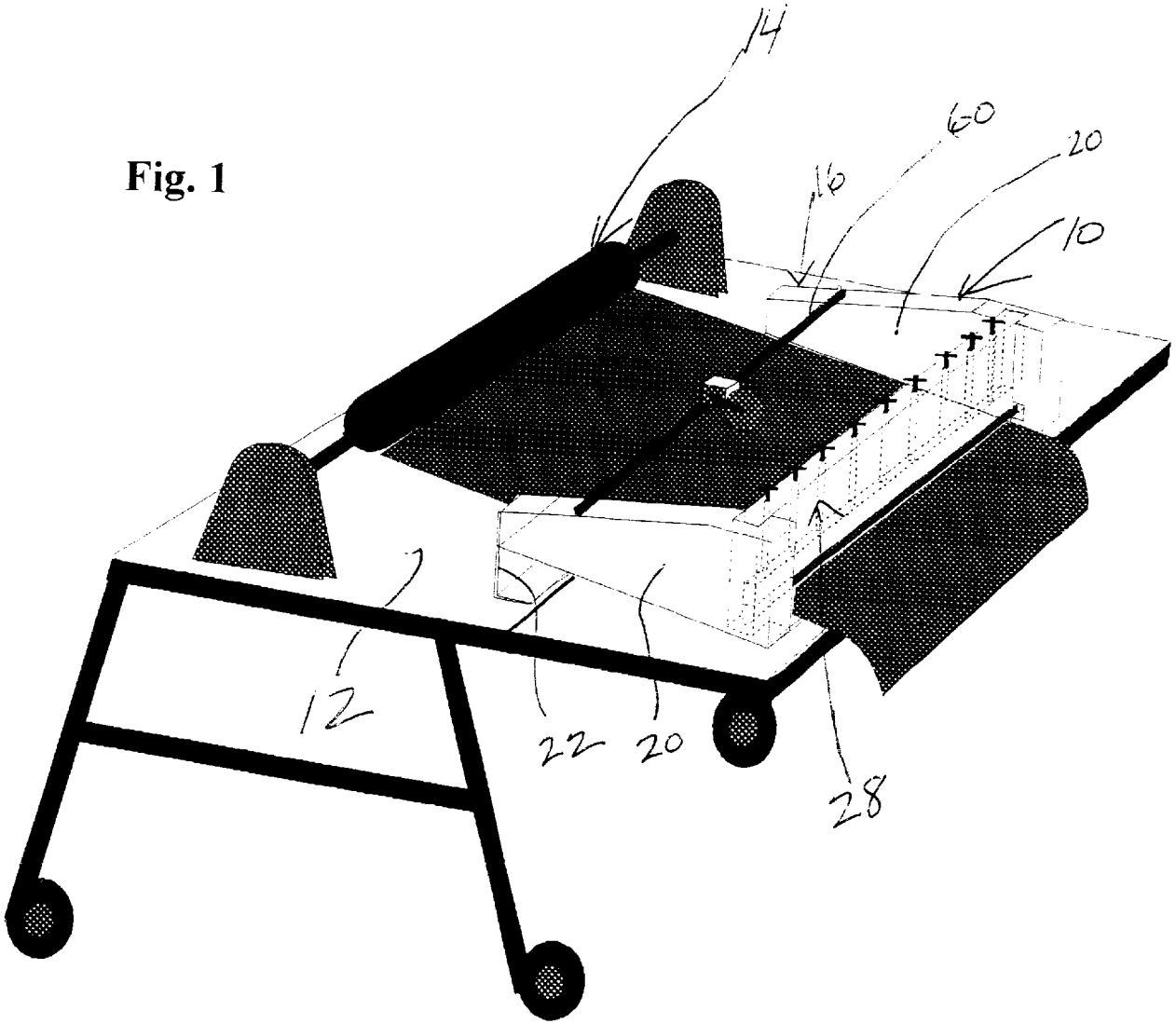
FIG. 1 is a perspective view of the wall paper paste applying apparatus of this invention, further showing the apparatus resting on a portable table for easy use by the paper hanger, and a reel for the continuous feeding of the paper to the apparatus.

This invention relates to apparatus for applying paste to the back side of wall paper, where the apparatus is mobile and intended to be placed on a surface, such as a table, for easy use by the paper hanger. Turning now to the several Figures, where like reference numerals represent like features or components throughout the several views, FIG. 1 illustrates an operating system according to this invention. The operating system comprises the paste applying apparatus 10, resting on a folding and portable table 12, for example, and a paper feeding reel 14 to supply an endless quantity of wall paper to the apparatus 10.

Figures 2, 3, 4:
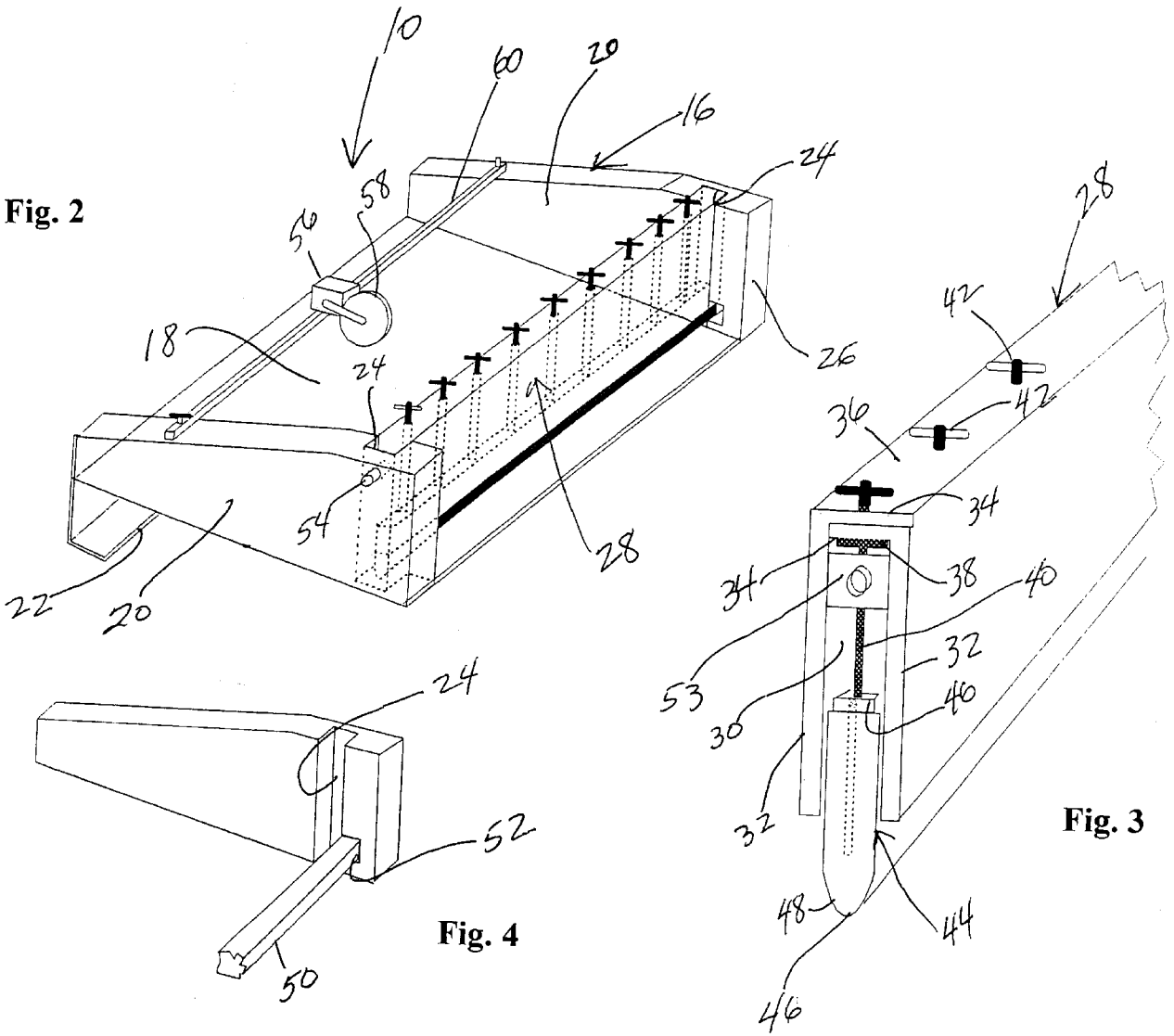
FIG. 2 is a perspective view of the paste containing trough forming a part of this invention.
FIG. 3 is an enlarged, partial perspective view of the adjustable third wall forming a part of the trough of FIG. 2.
FIG. 4 is an enlarged, partial perspective view of a support bar for cooperating with the adjustable third wall of FIG. 3 to help control the quantity of paste applied to the wall paper.

The apparatus 10, as best seen in FIG. 2, comprises a housing 16 formed by a slanted floor 18, and a pair of upstanding side walls 20 extending up from the floor 18. The slant or elevation of the floor is maintained by a forward leg 22. The side walls 20 include a pair of facing slots 24 in close proximity to the forward end 26 for receiving an adjustable third wall 28.

The third wall 28, illustrated in FIG. 3, comprises a U-shaped channel member 30, preferably formed of a pair of L-shaped members 32, where adjoining minor legs 34 form the top wall 36. Underlying the top wall is a metal plate 38 for threading engagement by threaded member 40 extending through the top wall 36 and terminating in a T-member 42 for manually turning the threaded member 40. The lower end of threaded member 40 is attached to a squeegee member 44 through a metal bar 46. By this arrangement, manual adjustment of the T-member 40 will cause the squeegee member 44 to move up or down the channel member 30. The squeegee member 44 is formed of a non-metallic material, such as plastic to avoid scoring or tearing of the paper, where a preferred material is "nylon". The free end 46 of the squeegee member 44 is tapered and rounded 48 so as not to present any sharp surfaces to the paper. Cooperating with the squeegee member 44 is a transverse bar 50 extending between a pair of openings 52 adjacent the facing slots 24, see FIG. 4, where control of the amount and distribution of the paste will be determined by the cooperative relationship and proximity of the squeegee member 44 and transverse bar 50.

To temporarily fix the relationship of the third wall 28 to the facing slots 24, the third wall may be provided with a pair of inserts 53, one on each side, where a pin or fastener 54 may be inserted through side wall 20 in alignment with slot 24 into the insert 53.

An optional feature of the apparatus 10 of this invention may be inclusion of a length counter 56 with contact roller 58, i.e. counts the running feet of the paper length, mounted to a transverse bar 60 extending between the side walls 20.

While it is recognized that variations, changes and modifications may be made to the apparatus of this invention, including the addition of a paper cutting mechanism, no limitation is intended to be imposed thereon except as set forth in the appended claims.

What is claimed is:

1. A portable and table mounted apparatus for applying and controlling distribution of paste to the back side of wallpaper, said apparatus comprising a housing having a slanted floor, a pair of opposing side walls, and a removably adjustable third wall to define a paste receiving trough, where said third wall comprises an inverted U-shaped channel member having a top wall and a pair of downwardly oriented side walls and a slidable and adjustable squeegee bar extending between said downwardly oriented side walls and vertically adjustable by manual means extending through said top wall.

2. The portable and table mounted apparatus according to claim 1, wherein said manual means comprises plural threaded members.

3. The portable and table mounted apparatus according to claim 2, wherein said squeegee bar is an elongated member mounting plural nuts for threadably engaging said plural threaded members.

4. The portable and table mounted apparatus according to claim 3, wherein said elongated member is manufactured of plastic.

5. The portable and table mounted apparatus according to claim 4, wherein said plastic is nylon.

6. The portable and table mounted apparatus according to claim 1, wherein said opposing side walls include a pair of opposing slots for slidably receiving said third wall, and means cooperating with said slots for securing said third wall therebetween.

7. The portable and table mounted apparatus according to claim 1, including a transverse bar extending between said opposing side walls to cooperate with said squeegee bar to control the application of paste to said wallpaper.

8. The portable and table mounted apparatus according to claim 1, including a transverse member extending between said opposing side walls, upstream of said third wall, mounting a length counter.

9. The portable and table mounted apparatus according to claim 8, including a paper feeding reel upstream to said length counter.

* * * * *